US006020728A

United States Patent [19]

Thus

[11] Patent Number: 6,020,728

[45] Date of Patent: Feb. 1, 2000

[54] CONTROL CIRCUIT WITH A SINGLE CONTROL INPUT FOR CONTROLLING DC AND AC CURRENTS IN A LOAD

[75] Inventor: Franciscus J. M. Thus, Eindhoven, Netherlands

[73] Assignee: U.S. Philips Corporation, New York, N.Y.

[21] Appl. No.: 09/094,833

[22] Filed: Jun. 15, 1998

[30] Foreign Application Priority Data

Jun. 16, 1997 [EP] European Pat. Off. ..... 97201807

[51] Int. Cl.[7] ..... G05F 1/10

[52] U.S. Cl. ..... 323/273; 323/315

[58] Field of Search ..... 323/273, 312, 323/315

[56] References Cited

U.S. PATENT DOCUMENTS 4,914,317 4/1990 Agiman ..... 327/108

5,469,047 11/1995 Kumamoto et al. ..... 323/312

5,535,085 7/1996 Tanaka et al. ..... 361/58

5,774,013 6/1998 Groe ..... 327/543

OTHER PUBLICATIONS

By Philips Application Handbook IC 03B, p. 1180 , Jul. 1996.

*Primary Examiner*—Adolf Deneke Berhane

[57] ABSTRACT

A control circuit for controlling a DC current and an AC current through an acoustic transducer such as a ringer or a buzzer in a telephone. The control circuit comprises a current controlled output stage with an output terminal for the acoustic transducer, and a driver transistor of which a main current path drives the output stage. The driver transistor has a single control input for controlling both the DC current and the AC current through the acoustic transducer.

7 Claims, 2 Drawing Sheets

Figure 1:
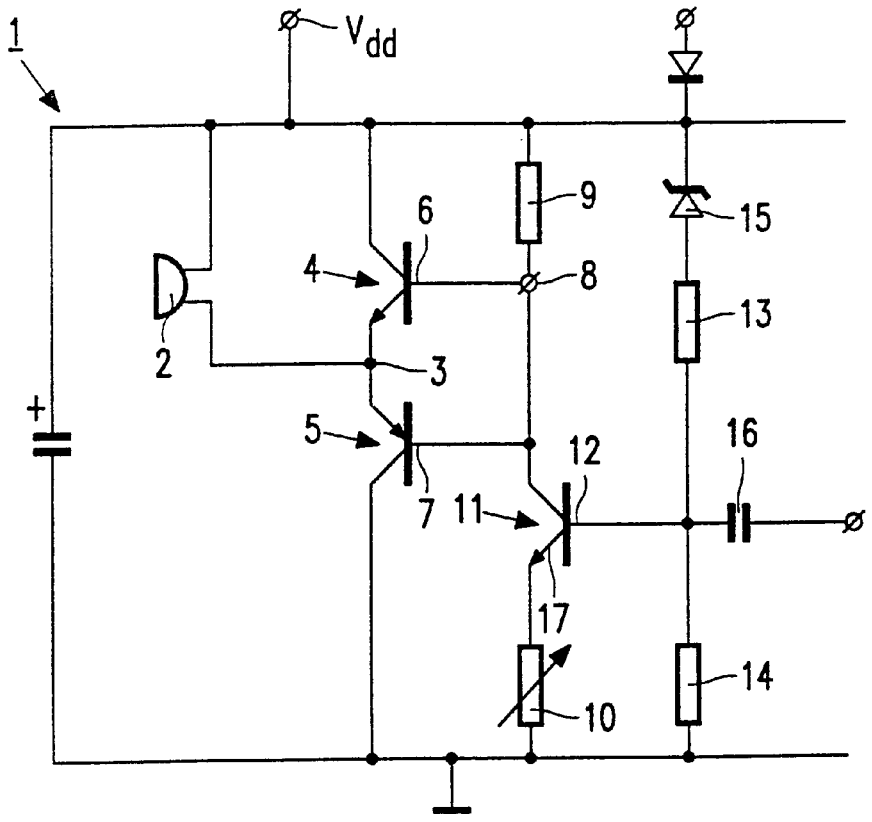
FIG. 1 PRIOR ART

CONTROL CIRCUIT WITH A SINGLE CONTROL INPUT FOR CONTROLLING DC AND AC CURRENTS IN A LOAD

The present invention relates to a control circuit for power load control. Particularly, the control circuit comprises a load output and an AC/DC load control means with a main current stream coupled to the load output, and at least one control input for controlling the AC/DC power load.

Such a control circuit is known from Philips Application Handbook IC 03b, page 1180, July 1996. The Handbook discloses a control circuit (see FIG. 1 of the present application) for controlling a load embodied as an acoustic transducer such as a buzzer or ringer, which is DC current controlled and AC current controlled by an AC/DC load control means. The DC current control provides for volume control of the noise produced by the buzzer, whereas the AC current control provides for pitch or melody control of said noise. Particularly the AC/DC load control means comprises a controllable semiconductor having an emitter used as a DC control input and a base used as an AC control input. The emitter is connected to a variable resistor for adjusting the DC current in the main current path, hereafter called stream of the controllable semiconductor, whereas the base is connected to a DC voltage adjusted node, which node is also connected to a capacitor for AC control input in order to adjust the AC current in the main current stream of the controllable semiconductor for buzzer volume and pitch control. It is a disadvantage of the relatively vulnerable and troublesome variable resistor and the capacitor, that these components are not or not easy to integrate, which gives rise to additional handling regarding required external connections to these components.

The present invention aims at obviating this disadvantage by minimizing the amount of required off-chip components.

To this end the control circuit according to the invention comprises a current source connected in series with the main current stream of the AC/DC load control means, the current source having one combined AC/DC control input. It is an advantage of the control circuit according to the invention that the current source makes use of only one combined AC/DC input, instead of separate inputs for AC and DC, respectively. This has the consequence of minimization of the number of necessary external components. The currently used off-chip variable resistor can be dispensed with. Furthermore, the voltage drop across the variable resistor no longer reduces the allowable voltage swing for improved dynamic pitch variation of the load voltage. Also the means to adjust the DC voltage of the node, such as resistors and a Zener diode, are no longer necessary, because a controllable semiconductor which is biased in a particular restpoint is no longer necessary. In addition, the capacitor which is not easy to integrate on a limited chip area can be dispensed with as well. The reliability and the size of the required chip area for the control circuit according to the invention is thus enhanced and reduced, respectively.

In one embodiment of the control circuit according to the invention requiring an absolute minimum number of components the current source comprises a controllable semiconductor.

In alternative embodiments applicable to a wide variety of circuitry the current source is a voltage controlled current source or a current controlled current source, respectively.

A further embodiment of the control circuit according to the invention provides for easy implementation in an output stage of an integrated circuit. In this further embodiment, the current controlled current source comprises a current mirror.

A still further embodiment of the control circuit according to the invention provides for very simple internal chip combination possibilities by mutual connections of AC and DC current sources. In this still further embodiment, the control circuit comprises an AC current source and a DC current source, and a current mirror has a current node coupled to the AC current source and the DC current source, respectively.

The present invention also relates to a bridging circuit, which is an alternative embodiment showing flexible AC and DC control properties. In the bridging circuit each of the two control circuits has a load output and a load is connectable between the two load outputs.

In addition, the present invention relates to an integrated circuit including at least one control circuit and to a telephone including such an integrated circuit.

Figure 2:
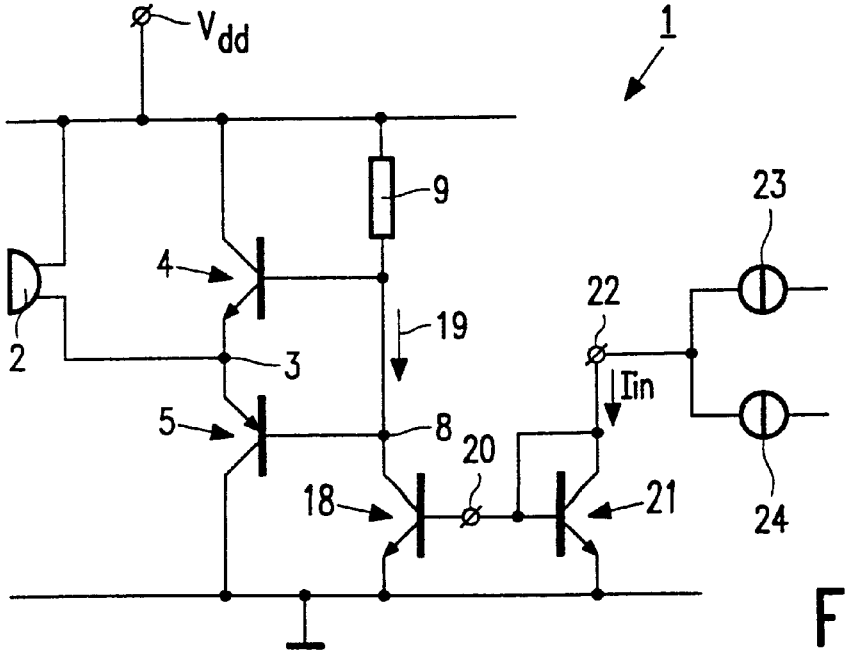
Figure 3:
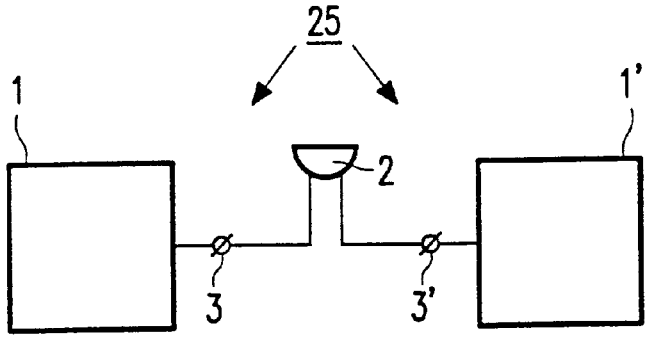
Figure 4:
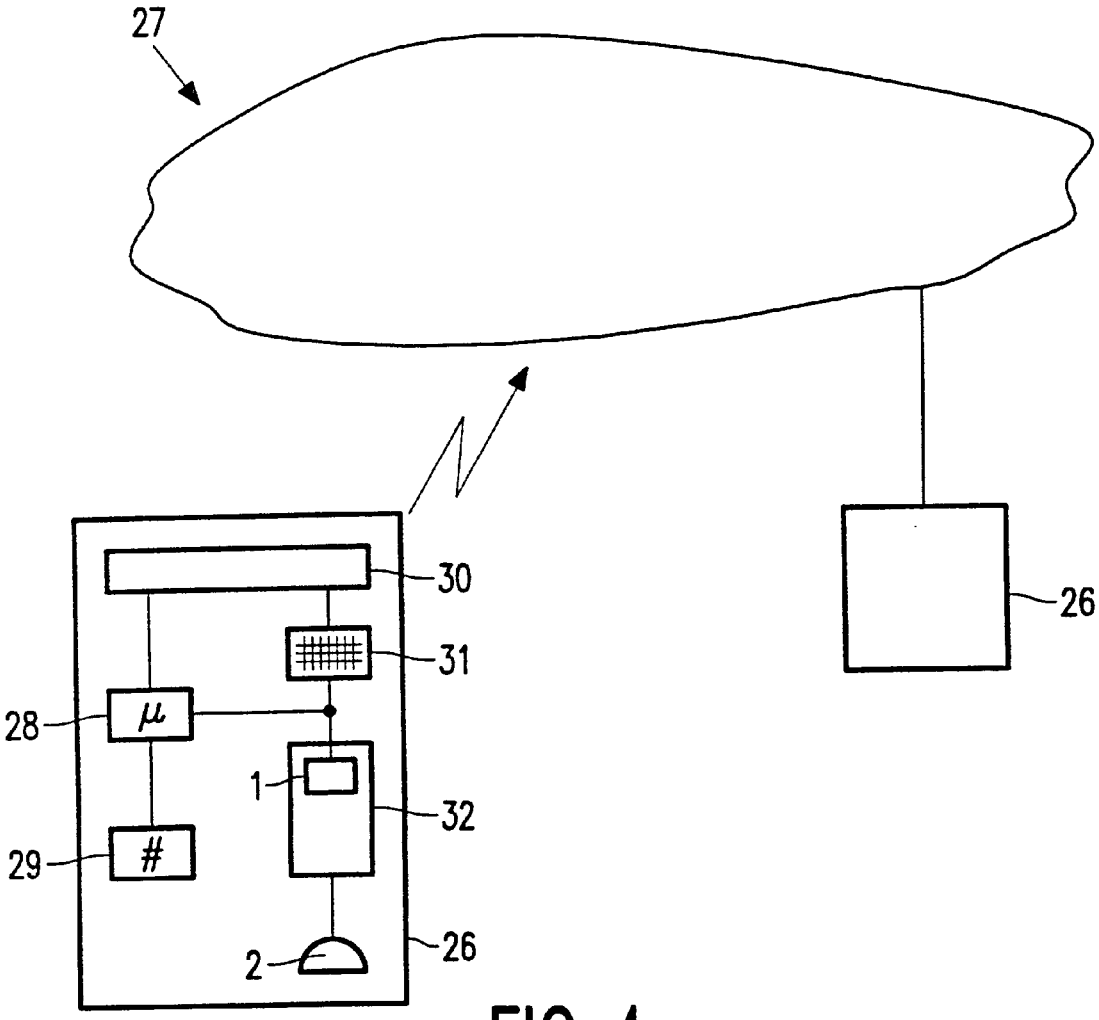

These and other aspects of the invention will be apparent and elucidated with reference to the embodiments described hereinafter. In the drawing, like components are referred to by like reference numerals. In the drawing:

FIG. 1 shows a prior art control circuit,

FIG. 2 schematically shows embodiments of the control circuit according to the invention, FIG. 3 shows a bridging circuit including two control circuits according to FIG. 2, and FIG. 4 schematically shows a telephone according to the invention including an integrated circuit which has a control circuit according to FIG. 2.

FIG. 1 shows a relevant part of a prior art control circuit 1 disclosed in the Philips Application Handbook mentioned above. The control circuit 1 comprises a load 2, embodied to be a capacitive load such as a buzzer. One side of the buzzer 2 is connected to supply voltage terminal Vdd, whereas its other side is connected to a connecting point 3 of an AC/DC control means comprising two collector-emitter junctions of two controllable semiconductors 4 and 5 each having a control input or a base 6, 7 which inputs are interconnected at a DC voltage adjusted node 8. The node 8 of the AC/DC control means is connected in series with a resistor 9, a variable resistor 10, and the main current stream, i.e. the main current path, or collector-emitter stream of a controlled semiconductor 11 embodied as a NPN transistor. The transistor 11 has a base 12 which is DC voltage adjusted by means of two resistors 13, 14 connected in series with a Zener diode 15 for stabilizing said DC voltage. A capacitor 16 is connected to the base 12 to insert an externally supplied AC control voltage for buzzer pitch control purposes, whereas the DC current in the main current stream of the transistor 11 is controlled by means of the variable resistor 10, which DC current corresponds to the volume of the noise produced by buzzer 2. The prior art control device and its AC/DC control means 4, 5, 11 have two separate control inputs viz. A DC control input at emitter 17 of transistor 11 and an AC control input at the basis 12 of transistor 11.

FIG. 2 shows the advantageous alternative to the control circuit of FIG. 1. The transistor 11 is now embodied as a current source 18 connected in series with the main current stream or path 19 of the AC/DC load control means 4, 5, 18. The current source transistor 18 of FIG. 2 has only one AC/DC control input 20 without any additional chip control lines being necessary. Again the functioning of the control circuit is such that the DC current in main current stream 19 of the current source transistor 18 corresponds to the volume of the buzzer, whereas the AC current in stream 19 corresponds to the pitch of the buzzer. When use is made of the control input 20, a DC control voltage thereat controls the DC current in stream 19 thus controlling said volume by means of controllable semiconductor 5, whereas an AC control voltage on control input 20 similarly influences said pitch. Pitch control is optimized because of the large voltage swing available on node 8 in the absence of further resistors in stream 19 apart from resistor 9.

Instead of making use of voltage control input 20, in an alternative embodiment the control circuit 1 comprises a current mirror transistor 21, which together with transistor 18 provides for a current-controlled current sourcing. Provided that the characteristics of transistors 18 and 21 are practically equal, then Iin equals stream current 19 and a current control input 22 becomes available for AC/DC current control in order to influence said volume and pitch of the buzzer 2. Current control input 22 then functions as a current node for internal chip AC and DC current sources such as 23, 24, respectively.

A bridging circuit 25 shows a further alternative in FIG. 3. Depending on the kind of load 2 applied it can be advantageous to double the control circuit 1 by adding a similar control circuit 1' and connect the load 2 between the respective terminals 3 and 3' of each of the respective control circuits 1 and 1' in order to alleviate Vdd dependence of the AC/DC control.

FIG. 4 shows a telephone 26 used by way of example in a communication system 27. Such a telephone 26, which can either be portable or fixed, generally contains a microprocessor 28, an associated memory 29, display screen 30, a keyboard 31, and particularly a buzzer 2 and associated buzzer control circuit 1 included in a telephone IC 32. Of course, the telephone 26 will comprise all further features properly implemented and necessary for the required functioning thereof, together with additional features such as a handsfree facility, listening in features, loudspeaker facilities, dialing features, charging facilities etcetera.

I claim:

1. A control circuit for controlling a DC current and an AC current through an acoustic transducer, said control circuit comprising:

a current controlled output stage with an output terminal for said acoustic transducer;

a driver transistor of which a main current path drives said output stage, said driver transistor having a single control input for controlling both said DC current and said AC current.

2. A control circuit as claimed in claim 1, wherein said driver transistor is voltage controlled.

3. A control circuit as claimed in claim 1, comprising a current mirror circuit formed of said driver transistor and a current mirror transistor coupled to said driver transistor, said current mirror transistor having a further main current path of which a current is mirrored into said main current path, and a further control input providing current control of said current mirror circuit.

4. A control circuit as claimed in claim 3, wherein an DC current source and an AC current source are DC-coupled to said further control input, said DC current source controlling said DC current through said acoustic transducer and said AC current source controlling said AC current through said acoustic transducer.

5. A control circuit as claimed in claim 1, wherein said current controlled output stage comprises a pair of complementary transistors of which main current paths are series connected, a common output electrode of said complementary transistors being said output terminal.

6. A bridging circuit comprising:

a first and a second control circuit for cooperatively controlling a DC current and an AC current through an acoustic transducer coupled between respective first and second output terminals of said first and second control circuits, said first control circuit comprising a first current controlled output; and a first driver transistor of which a main current path drives said first output stage; and said second control circuit comprising a second current controlled output stage; and a second driver transistor of which a main current path drives said second output stage;

said first and second driver transistors having respective single control inputs for cooperatively controlling said DC current and said AC current.

7. A telephone comprising:

an acoustic transducer; and a control circuit for controlling a DC current and an AC current through said acoustic transducer, said control circuit comprising a current controlled output stage with an output terminal for said acoustic transducer;

a driver transistor of which a main current path drives said output stage, said driver transistor having a single control input for controlling both said DC current and said AC current.

* * * * *